US005319889A

United States Patent [19]

Rudolf et al.

[11] Patent Number: 5,319,889

[45] Date of Patent: Jun. 14, 1994

[54] GRINDER WITH DUST EXHAUST MEANS

[75] Inventors: Boris E. Rudolf, Stuttgart; Horst Milsch, Weinstadt, both of Fed. Rep. of Germany

[73] Assignee: C. & E. Fein GmbH & Co., Stuttgart, Fed. Rep. of Germany

[21] Appl. No.: 104,243

[22] Filed: Aug. 9, 1993

Related U.S. Application Data

[63] Continuation of Ser. No. 923,299, Jul. 31, 1992, abandoned.

[30] Foreign Application Priority Data

Aug. 3, 1991 [DE] Fed. Rep. of Germany ..... 4125796

[51] Int. Cl.[5] ..... B24B 23/02; B24B 55/06

[52] U.S. Cl. ..... 51/170 T; 51/170 R; 51/273

[58] Field of Search ..... 51/170 R, 174, 177, 51/170 T, 170 MT, 268, 273

[56] References Cited

U.S. PATENT DOCUMENTS

| | | | |
|---|---|---|---|
| 2,929,177 | 3/1960 | Sheps | 51/273 |
| 3,722,147 | 3/1973 | Brenner | 51/174 |
| 3,938,283 | 2/1976 | Keith | 51/170 R |
| 4,071,981 | 2/1978 | Champayne | 51/170 MT |
| 4,102,083 | 7/1978 | Stern | 51/170 R |
| 4,296,572 | 10/1981 | Quintana | 51/170 TL |
| 4,891,915 | 1/1990 | Yasuda | 51/170 T |
| 4,905,420 | 3/1990 | Flaschenecker et al. | 51/170 R |
| 4,920,702 | 5/1990 | Kloss | 51/170 R |
| 4,924,635 | 5/1990 | Rudolf | 51/170 R |
| 5,125,190 | 6/1992 | Buser | 51/170 T |

FOREIGN PATENT DOCUMENTS

| | | | |
|---|---|---|---|
| 8523993 | 8/1985 | Fed. Rep. of Germany | B24B 55/04 |
| 3724747 | 7/1987 | Fed. Rep. of Germany | B24B 55/10 |

OTHER PUBLICATIONS

International Design No. DM/008839, Date of Deposit: Jun. 25, 1987.

*Primary Examiner*—Bruce M. Kisliuk
*Assistant Examiner*—Bo Bounkong
*Attorney, Agent, or Firm*—Barry R. Lipsitz

[57] ABSTRACT

The invention proposes a grinder having a rocking shaft adapted to set a grinding tool into an oscillating movement about a rocking axis fixed to the device, the grinding tool having a grinding surface comprising at least one corner area. For the purpose of extracting the grinding dust, there is provided a suction hood, which can be fixed on the device and which communicates with a suction pipe. In order to prevent the risk of surface marks forming during micro-finishing of surfaces, and at the same time to guarantee efficient dust removal, the grinding surface is designed as a continuous, closed surface, without any openings, the suction hood enclosing the grinding tool from above and at least part of the lateral faces of the grinding tool. The suction pipe opens laterally into the suction hood in an area opposite the corner area of the grinding surface. Further, the suction hood comprises a suction chamber extending from the suction pipe to the corner area of the grinding tool.

7 Claims, 3 Drawing Sheets

GRINDER WITH DUST EXHAUST MEANS

This application is a continuation of commonly assigned, copending U.S. patent application Ser. No. 07/923,299 filed Jul. 31, 1992, now abandoned.

The present invention relates to a grinder with dust exhaust means having a rocking shaft adapted to set a grinding tool into an oscillating movement about a rocking axis fixed to the device, the grinding tool having a grinding surface comprising at least one corner area, and a suction hood, which can be fixed on the device, being provided for extracting the grinding dust through a suction pipe.

A grinder of this type has been known from U.S. Pat. No. 4,905,420. In the case of this known device, the grinding surface is provided with a plurality of suction openings through which the dust produced at the grinding surface is extracted via a suction hood mounted on the device.

A device of this type allows practically dust-free working, an aspect which is particularly important with materials that are injurious to health.

However, it has been found that grinders of this type are suited for micro-finishing of surfaces only with certain restrictions, in particular when the surfaces consist of relatively soft materials, such as acrylic glass, or of a very hard material, such as stone or rock. Even when working with extreme care, surface marks in the micro range cannot be avoided in dry grinding of such materials.

DE 85 23 993 Ul further discloses a suction hood for a grinder which can be mounted on the grinder from above and which encloses the grinder completely, projecting a long way over its edges.

Such a suction hood, which is in no way adapted to the grinder geometrically, has only little suction efficiency which is insufficient for most applications. Moreover, the greatly increased overall depth of the combined arrangement is a considerable disadvantage, providing a serious obstruction to work in areas that are difficult to access, such as edges, which work otherwise could be performed by the corner area of the grinding tool.

Now, it is the object of the present invention to provide a grinder which reduces the risk of marks forming during grinding, and which simultaneously guarantees a satisfactory suction effect.

According to the invention, this object is achieved with a grinder of the before-described type by the fact that the grinding surface is designed as a continuous, closed surface, without any openings, that the suction hood encloses the grinding tool from above and at least part of the lateral faces of the grinding tool, that the suction pipe opens laterally into the suction hood in an area opposite the corner area of the grinding surface, and that the suction hood comprises a suction chamber extending from the suction pipe to the side of the grinding tool opposite the suction pipe and tapering off toward the top of the grinding tool.

According to the invention, therefore, the grinding surface is designed as a closed surface. The fact that the grinding surface is free from suction openings does away with all the problems encountered at the edges of the suction openings of conventional grinders. It also avoids the formation of projections at the edges of suction openings which in the case of conventional grinders may be produced during operation by heavy mechanical stresses in the neighborhood of the suction openings. At the same time, fraying of the grinding wheel around the suction openings is avoided and uniform surface finishing is rendered possible.

A good suction effect is achieved due to the fact that the suction hood encloses the grinder from above, enclosing simultaneously at least part of the lateral faces of the grinder, and this in combination with the fact that the suction pipe opens laterally into the suction hood at a point opposite the corner area of the grinding surface, and that a suction chamber extends from the suction pipe to the corner area of the grinding tool.

Even in the corner area, which in most of the cases is subjected to greater stress, the suction effect is sufficient to prevent scoring.

Given the fact that the suction hood encloses the grinding mechanism laterally at a small distance only, the freedom of movement is practically not restricted in working marginal or corner areas.

According to an advantageous further development of the invention, the cross-section of the suction chamber tapers from the suction pipe toward the opposite side of the grinding tool.

In a suction chamber of uniform cross-section, the vacuum would diminish over the length of the suction channel so that the suction effect would be considerably reduced at the end of the channel. The tapering cross-section now results in a higher air velocity, in spite of the reduced vacuum and, thus, in efficient suction, the extracted air mass being reduced in accordance with the reduction in cross-section.

In this way, a uniform exhaust effect is ensured over the entire marginal area. The good suction effect is ensured even in the corner area which normally is subjected to greater working stress so that a greater amount of dust will be generated in this area.

According to another further development of the invention, the grinding tool has a triangular grinding surface and a heart-shaped suction chamber, the pointed end of the heart shape matching the corner area of the grinding surface, and the suction pipe opening into the suction chamber at a point opposite the pointed end of the heart shape.

It has been found that when the grinding surface of the grinder has a triangular shape, the heart-shaped design of the suction chamber allows a particularly advantageous adaptation to the existing flow conditions. It is thus possible to avoid friction losses and, in combination with the reduction in cross-section of the suction chamber from the suction pipe toward the opposite corner area, to achieve a uniform suction effect, both in the remote corner area opposite the suction pipe and in the two lateral corner areas that are closer to the suction pipe.

According to another embodiment of the invention, the suction hood comprises a central connecting sleeve by which it is mounted on the drive housing and through which the rocking shaft is passed.

This design ensures simple and easy mounting of the suction hood on the drive housing.

According to another further development of the invention, the connecting sleeve is equipped with an extension which projects into the suction chamber and which is sealed from the grinding tool.

This arrangement provides the advantage that any reduction of the suction effect due to secondary air being drawn in through the connecting sleeve is avoided.

According to still another embodiment of the invention, the suction pipe has an approximately kidney-shaped cross-section with a lower sidewall, on the side of the grinding tool, of slightly convex, outwardly curved shape and an upper sidewall of slightly concave, inwardly curved shape.

This design of the suction pipe ensures the least possible flow resistance at the point where the suction pipe opens into the heart-shaped suction channel which includes at its center the extension of the connecting sleeve.

According to an advantageous further development of the invention, the suction hood is made from a plastic material. This permits easy production by injection-molding processes, and ensures low weight.

It is understood that the features that have been mentioned before and that will be described hereafter may be used not only in the stated combinations, but also in any other combination or each alone, without departing from the scope of the present invention.

One embodiment of the invention will now be described in more detail with reference to the drawing in which FIG. 1 shows a section through part of the lower area of a grinder according to the invention, with mounted suction hood;

Figure 1:
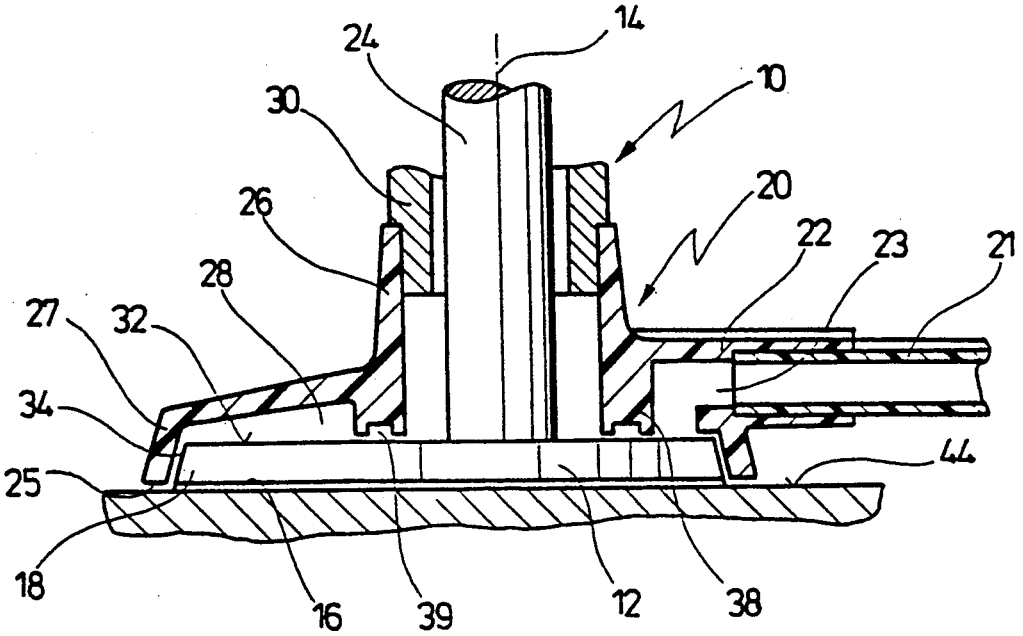

In FIG. 1, a grinder according to the invention is indicated generally reference numeral 10. It comprises a drive housing 30 accommodating a rocking shaft 24 adapted to set a grinding tool 12 into an oscillating movement about a rocking axis 14 fixed to the device.

Figure 5:
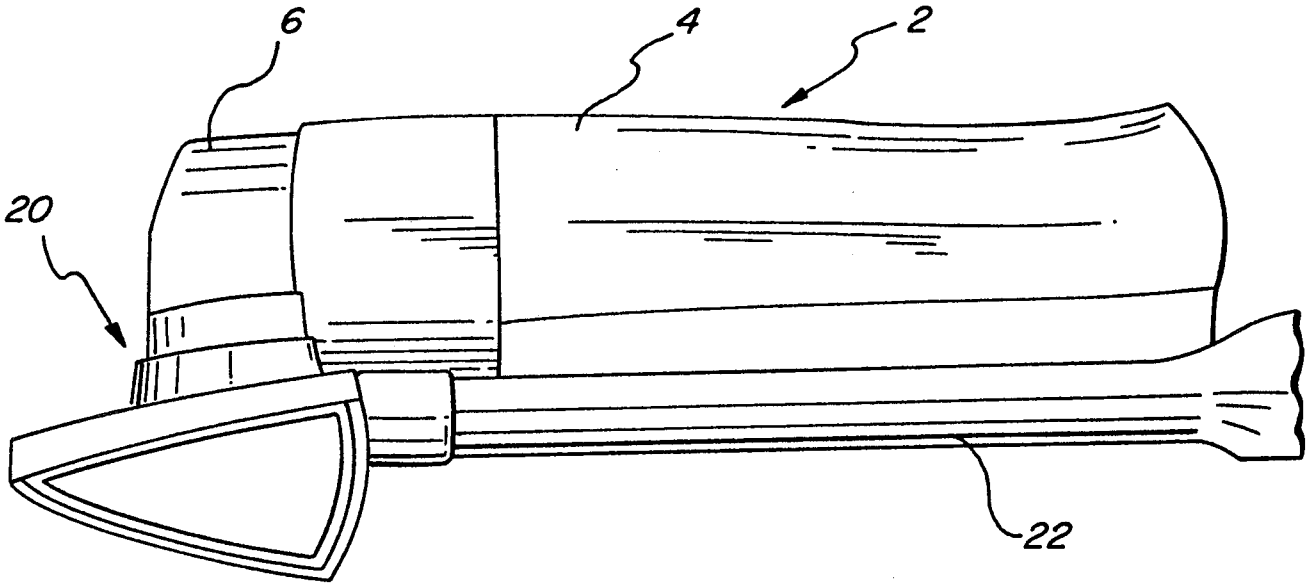
FIG. 5 shows a perspective view of a grinder according to the invention, with a housing, driving motor and drive gear.

The drive—illustrated in FIG. 5—is fully identical to that of the grinder known from U.S. Pat. No. 4,905,420 as regards its structure and operation. As illustrated in FIG. 5, the drive includes a housing 2, driving motor 4, and drive gear 6. A suction hood 20 and suction pipe 22, also shown in FIG. 5, are described in greater detail below.

The free end of the rocking shaft 24 carries the grinding tool 12 which comprises a triangular grinding surface 16. The grinding tool 12 is enclosed by a suction hood designated generally by reference numeral 20. The suction hood 20 comprises a central connecting sleeve 26, which slightly tapers on its outside and which terminates in the hood 20 by a cylindrical extension 38 extending right to the grinding tool 12. The connecting sleeve 26 is fitted on the flange-like end of the drive housing 30 and may be additionally fixed thereon, for example by a clamping ring.

Inserted in the end face of the extension 38 is a sealing ring 39 which is in sealing engagement with the rear face 32 of the grinding tool 12 opposite the grinding surface 16.

The outer shape of the suction hood 20 is adapted to the triangular shape of the grinding tool 12. The suction hood 20 comprises three lateral faces 27 of slightly convex shape, which are arranged symmetrically relative to the connection sleeve 26 and which form an external cover for the lateral faces 34 of the grinder 12 and have their end faces 25 slightly set off from the grinding surface so that a small gap is formed between the end faces 25 and the surface to be worked 44 across which the grinding tool 12 is moved.

This prevents the end faces 25 from getting into contact with the surface to be worked 44, without thereby impairing the suction effect.

The three lateral faces 27 of the suction hood are interconnected by flattened corners 29. The distance of the lateral faces 27 of the suction hood from the lateral faces 34 of the grinding tool 12 is selected in such a way that the grinding tool is permitted to oscillate about the rocking axis 14 by a small swing angle of up to approximately 7°, at a high frequency of up to approximately 25,000 oscillations per minute, without the grinding tool 12 getting into contact with the lateral surfaces 27 of the suction hood 20.

Figure 2:
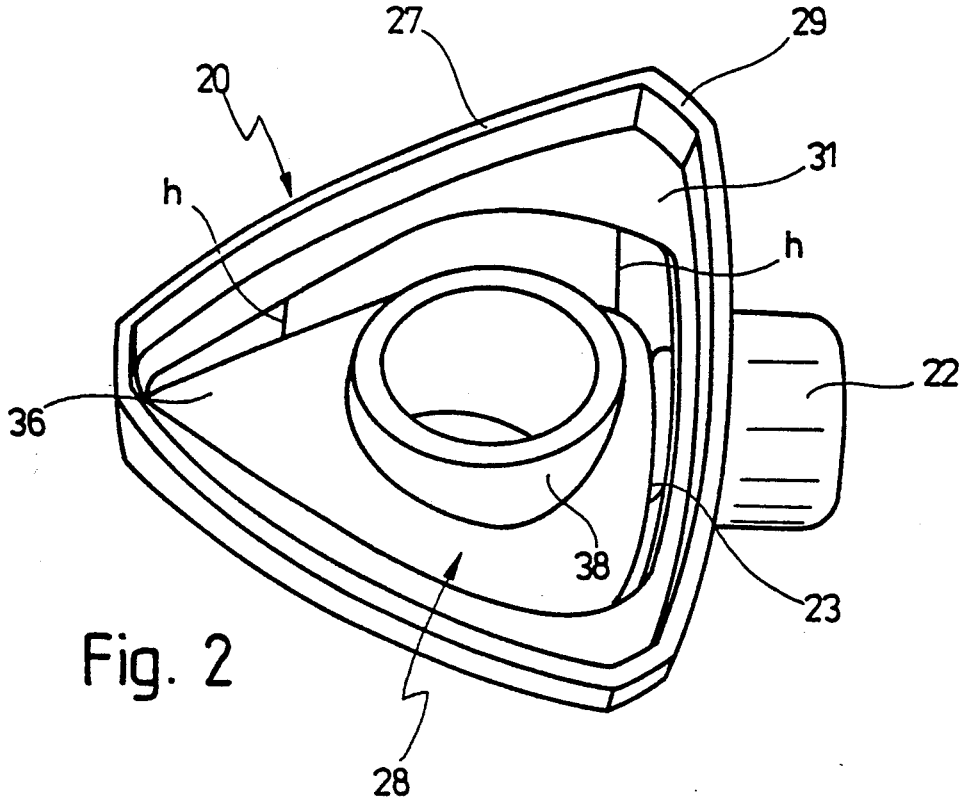
FIG. 2 shows a perspective bottom view of the suction hood according to FIG. 1.
Figure 3:
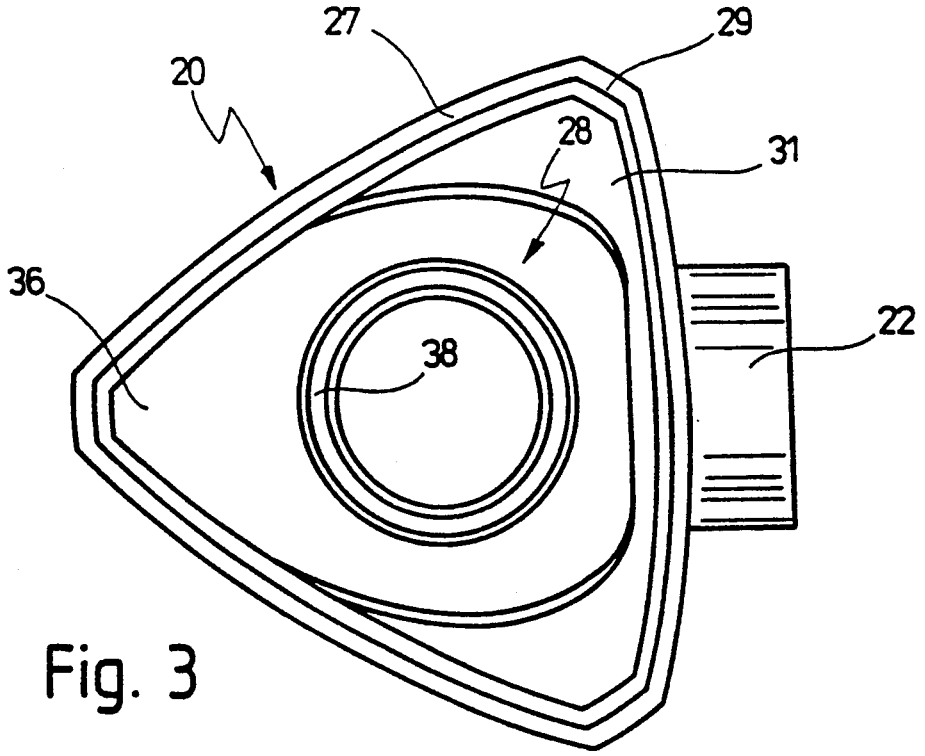
FIG. 3 shows a bottom view of the suction hood according to FIG. 2.

As can be seen in FIGS. 2 and 3, the lateral faces 27 and the corners 29 of the hood 20 are delimited by a hood top 31 extending substantially in parallel to the rear face 32 of the grinding tool 12, but being slightly curved in the direction of the central extension 38. The distance between the hood top 31 and the rear face 32 of the grinding tool 12 is in the order of a few millimeters only.

Into the hood top 31, a suction chamber 28 is recessed, extending from a suction pipe 22 opening into the chamber laterally between two corners 29 of the suction hood 20, to the opposite corner 29. Regarding the bottom view of FIG. 3, the suction chamber 28 exhibits the shape of a heart, the pointed end 36 of the heart shape terminating directly at the corner 29 of the suction hood. The suction chamber 28 encloses the central extension 38 symmetrically by both sides, and its broad end opposite the pointed end 36 communicates directly with the suction pipe 22, via an opening 23.

The cross-section of the suction chamber 28 tapers from the opening 23 toward its opposite pointed end 36. This is due to the fact that the distance h between the hood top 31 and the upper face of the suction chamber 28 diminishes continuously from the side of the suction pipe 22 toward the pointed end 36. At its pointed end 36, the suction chamber 28 eventually tapers off at the hood top 31.

Figure 4:
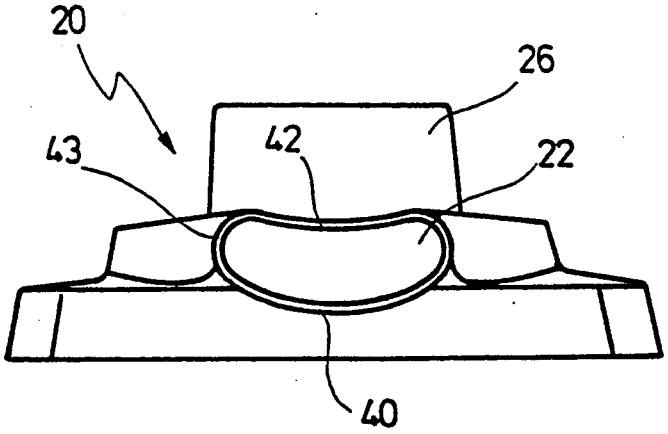
FIG. 4 shows an elevation of the suction hood according to FIGS. 1 to 3.

FIG. 4 illustrates the cross-section of the suction pipe 22. The suction pipe 22 has an approximately kidney-shaped cross-section with a lower sidewall 40, on the side of the grinding tool 12, of slightly convex, outwardly curved shape and an upper sidewall 42 of slightly concave, inwardly curved shape. The two approximately parallel sidewalls 40, 42 are interconnected laterally by curved wall sections.

According to FIG. 1, the suction pipe 22 is adapted to receive a male pipe section 21 whose cross-section is adapted to the suction pipe 22 in such a way as to produce a substantially air-tight connection. The male pipe section is guided in parallel to the drive housing 30, in a manner not shown in the drawing. In addition, it may be held on the drive housing 30 by a strap or a velcro-fastening, as in the U.S. Pat. No. 4,905,420. It is connected to a suction unit via a suction hose.

We claim:

1. A grinder with dust exhaust means, said grinder comprising:

a housing accommodating a driving motor coupled to a drive gear;

a rocking shaft driven by said drive gear for oscillatingly moving about a rocking axis fixed with respect to said housing;

a grinding tool removably fixed to said rocking shaft and having a grinding surface, said grinding surface limited by lateral faces intersecting said grinding surface and comprising at least one corner area;

a suction hood means fixed to said housing for extracting dust and other particles originating from grinding, said suction hood means comprising a suction chamber;

a suction pipe means coupled to said suction hood means on a first end thereof and coupled to a suction device on a second end thereof;

wherein said grinding surface comprises a continuous, closed surface without any openings;

wherein said suction chamber encloses said grinding tool from a side opposite said grinding surface and also encloses said lateral faces at least partially;

wherein said first end of said suction pipe means opens laterally into said suction chamber, said suction chamber extending from said first end of said suction pipe means to an opposite end of said suction hood means; and wherein said suction chamber has a cross-section that tapers from said first end of said suction pipe means towards said opposite end of said suction hood.

2. A grinder according to claim 1, wherein said grinding tool has a triangular grinding surface.

3. A grinder according to claim 2, wherein said suction chamber has a generally heart-shaped form having a pointed end matching said one corner area of said grinding surface, and wherein said suction pipe means opens into said suction chamber opposite said pointed end of said heart-shaped form.

4. A grinder according to claim 1, wherein said suction hood means comprises a central connecting sleeve which is attached to said housing and through which said rocking shaft is passed.

5. A grinder according to claim 4, wherein said connecting sleeve includes an extension which projects into said suction chamber and which is sealed from said grinding tool.

6. A grinder according to claim 1, wherein said suction pipe means has an approximately kidney-shaped cross-section with a lower sidewall of slightly convex, outwardly curved shape on said first end and with an upper sidewall of slightly concave, inwardly curved shape.

7. A grinder according to claim 1, wherein said suction hood means is made from a plastic material.

* * * * *